United States Patent [19]

Lorrek

[11] 4,358,345

[45] Nov. 9, 1982

[54] ARRANGEMENT FOR FEEDING GLOWING COKE

[75] Inventor: Johannes Lorrek, Essen, Fed. Rep. of Germany

[73] Assignee: Krupp-Koppers GmbH, Essen, Fed. Rep. of Germany

[21] Appl. No.: 212,680

[22] Filed: Dec. 3, 1980

[30] Foreign Application Priority Data

Jan. 31, 1980 [DE] Fed. Rep. of Germany ..... 3003374

[51] Int. Cl.[3] ..... C10B 39/02

[52] U.S. Cl. ..... 202/228; 201/39; 202/262

[58] Field of Search ..... 201/39; 202/228, 227, 202/262, 263

[56] References Cited

U.S. PATENT DOCUMENTS

| | | | |
|---|---|---|---|
| 1,854,407 | 4/1932 | Janeway, Jr. | 202/228 |
| 4,024,023 | 5/1977 | Jonnet | 202/228 |
| 4,033,730 | 7/1977 | Baron et al. | 202/262 |
| 4,092,222 | 5/1978 | Katoaka et al. | 202/263 |

*Primary Examiner*—Norman Yudkoff

*Attorney, Agent, or Firm*—Michael J. Striker

[57] ABSTRACT

An arrangement for feeding glowing coke has a cooling shaft into which coke and cooling gas are received, a coke transporting container arranged on the shaft and having a closable bottom opening, and a closing device arranged in the cooling shaft below the coke transporting container and including a housing sealed from atmosphere, and a closing plate which is raisable and lowerable and also displaceable in substantially horizontal direction in the housing.

11 Claims, 3 Drawing Figures

ARRANGEMENT FOR FEEDING GLOWING COKE

BACKGROUND OF THE INVENTION

The present invention relates to an arrangement for feeding glowing coke in a cooling shaft in which cooling gas is admitted.

Arrangement of the above-mentioned general type are known in the art. A known arrangement has a cooling shaft in which glowing coke is fed and cooling gas is admitted, and the cooling shaft is provided with a coke transporting container which has a closable bottom opening wherein a closing device is arranged below the heating region of the coke transporting container in the cooling shaft. The closing device serves for gas tight closing of the cooling shaft. It must prevent escape of hot dust-containing gas from the cooling shaft and thereby contamination of the surrounding atmosphere. On the other hand, a closing device must be so constructed and arranged that during emptying of the coke transporting container the filling cross-section of the cooling shaft must be completely unobstructed so as to avoid interference with the flow of the glowing coke into the cooling shaft. The known closing devices possess some disadvantages in the sense of performing their operational functions and simplicity of their construction.

SUMMARY OF THE INVENTION

Accordingly, it is an object of the present invention to provide an arrangement for feeding glowing coke, which avoids the disadvantages of the prior art.

More particularly, it is an object of the present invention to provide an arrangement for feeding glowing coke which effectively performs its intended functions and has a relatively simple construction.

In keeping with these objects and with others which will become apparent hereinafter, one feature of the present invention resides, briefly stated in an arrangement having means forming a cooling shaft, a coke transporting container arranged on the shaft and having a closable bottom opening, and a closing device arranged in the cooling shaft below the coke transporting container, wherein the closing device includes a housing sealed from the atmosphere, and a closing plate which is raisable and lowerable and also displaceable in a substantially horizontal direction.

When the arrangement is designed in accordance with the present invention, it effectively performs its intended functions and has a relatively simple construction. The closing plate can be lifted from its seat and withdrawn from the region of the filling passage of the cooling shaft. The sealed housing guarantees that with the mounted coke transporting container, a gas tight closure of the cooling shaft from the atmosphere is provided.

In accordance with another feature of the present invention, the closing plate may have a peripheral portion formed by downwardly bent projection which dips in a sand seal a body of water or the like. In sealing position, the plate abuts against the mouth portion of the cooling shaft and dips in the above-mentioned sealing body so that escape of gases from the cooling shaft is reliably prevented. Because of the simple construction of the plate, it is not susceptible to deleterious condition in which it operates, such as heat, dust, and the like.

The coke transporting container which transports the glowing coke from the coke oven battery in known manner, must be fitted for its emptying onto the cooling shaft. Care must be taken of the provision of a tight seat for the same.

In accordance with still another feature of the present invention, the coke transporting container is provided with one or more cover plates which are pivotable upwardly for receipt of the coke. At least one of these cover plates may be provided with guiding projections for guiding a coke into a respective part of the coke transporting container.

Finally, a further featue of the present invention resides in that the coke transporting container is provided with raisable and lowerable bottom closures. The cooperation of this closure with the plate-shaped closing device of the cooling shaft provides in each operational phase a gas tight closure of the shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
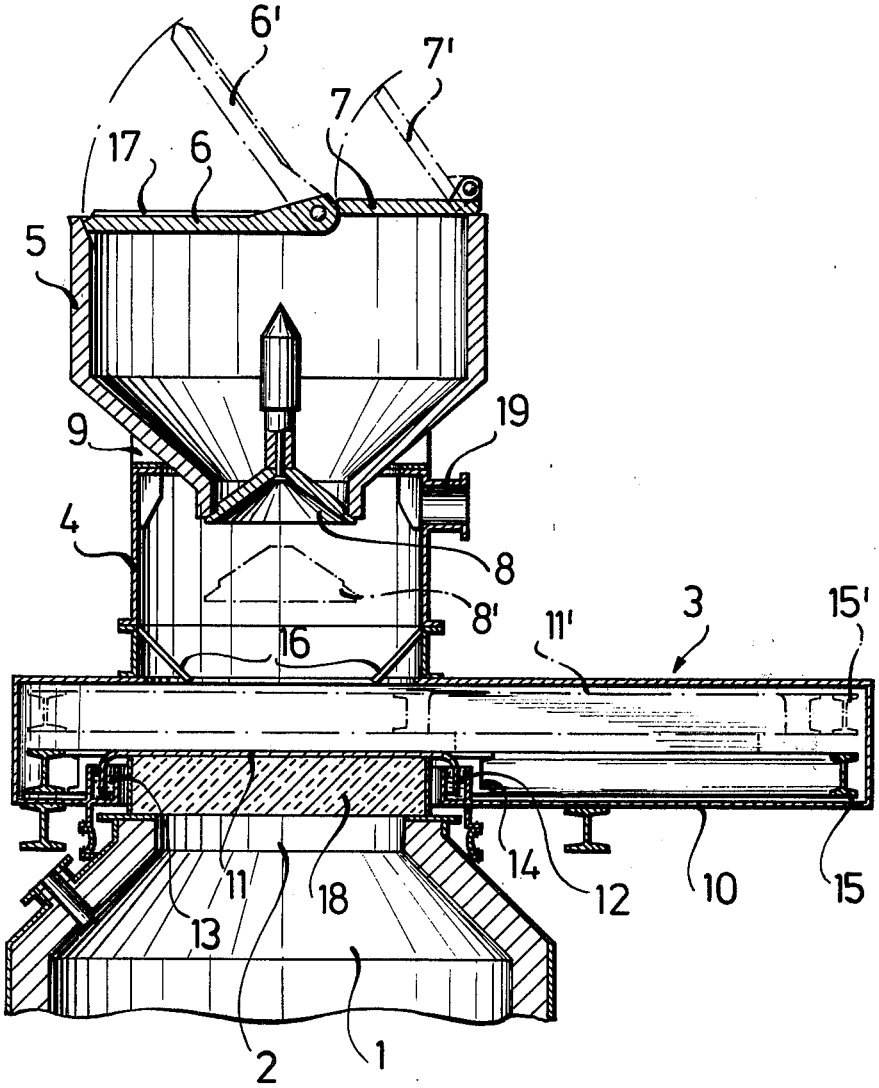
FIG. 1 is a view showing a section of an arrangement for feeding glowing coke in accordance with the present invention.

An arrangement for feeding glowing coke includes a cooling shaft which has an upper region identified by reference numeral 1. The upper region 1 has a cross-section which reduces upwardly to a mouth portion 2 of the cooling shaft.

A closing device which is shown schematically and identified in toto by reference numeral 3 is arranged above the mouth portion 2. A lower support housing 4 for a coke transporting container 5 is arranged above the closing device 3.

Figure 3:
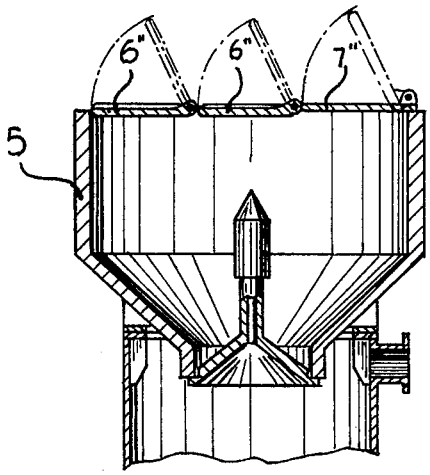
FIG. 3 is a view substantially corresponding to the view of FIG. 1 but showing the arrangement in accordance with a further embodiment.

The coke transporting container 5 has two cover plates 6 and 7 for receiving the glowing coke. When the coke transporting container is brought close to a coke oven chamber to be emptied, the cover plates 6 and 7 are pivoted upwardly. More than two cover plates can be provided in the coke transporting container 5 as shown in FIG. 3 and identified by reference numerals 6″ and 7″. The coke transporting container 5 has a conical bottom closure which is raisable and lowerable as identified by reference numerals 8 and 8′. The actuating arrangements for the cover plates and the bottom closure are not shown in the drawing for the sake of clarity. They can have conventional construction which is suitable for performing the functions of the above-mentioned elements.

The coke transporting container 5 rests on a seat 9 of the lower support housing 4. The seat is so formed as to prevent escape of gases between the lower support housing 4 and the coke transporting container 5.

As can be seen from the drawing, the cover plates 6 and 7 in FIG. 1 are turnable upwardly so as to assume positions identified by reference numerals 6' and 7'. The same is true with respect to the covers 6'' and 7'' of FIG. 3l. The longer plates 6 and 6 serves, during filling of the coke transporting container, simultaneously as a guiding arrangement for a portion of the coke which is supplied from above left, as seen in the drawing, from the not shown coke guide of the coke transporting container. A mass of coke slides over the plate 6 into the part of the coke transporting container, which faces away from the coke guide, and thereby provides for substantially uniform filling.

Uniform filling of the coke transporting container 5 can be further improved by provision of guiding means on the cover plates. As can be seen from the drawing, the upper surface of the cover plate 6 is provided with an inclined guiding projection 17. The coke is guided laterally by the guiding projection 17 and thereby provides for improved distribution of the coke over the width of the plate so as to allow distribution of the coke over the width of the coke transporting container 5.

Figure 2:
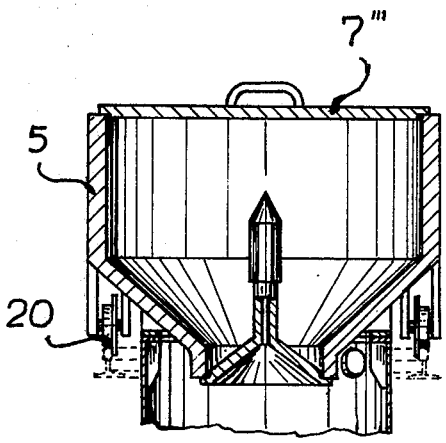
FIG. 2 is a view substantially corresponding to the view of FIG. 1 but showing the arrangement in accordance with another embodiment of the invention.

The uniformity of distribution of the coke in the coke transporting container may be attained in another manner. The coke transporting container 5 can rotate during its filling so that the entire container region can be brought to the coke guide. The coke transporting container is provided in this case with a rotary drive which may include wheel 20 arranged on the container and a circular rail shown in dotted lines in FIG. 2. The rail is arranged on a not shown carriage which supports the coke receiving container and travels in front of the oven chamber to be emptied. The rotary drive may also include; a roller bearing or ball hearing. In the shown construction, the turnable cover plates 6 and 7 are replaced by one removable plate 7''' which is preferably of one-piece.

The closing device 3 includes a closed housing 10 and a plate 11 accommodated in the housing 10. The plate 11 has at its periphery a downwardly extending projection 12. This projection can be formed, as shown in the drawing, by bent edge portions of the plate 11. The projection 12 engages in a sealing body such as a sand seal 13, a body of water, or the like. The plate 11 is provided with a refractory insulation 18 facing toward the cooling shaft 1. In closing position, the refractory insulation 18 comes into abutment against the mouth 2 of the cooling shaft and thereby provides for presealing of the same.

The plate 11 is connected with a frame 14 which are supported on a frame 15 via rollers or wheels. When the frame 18 is lifted to the position identified by reference numeral 15', the plate 11 is withdrawn from the sand seal 13. Then, the plate 11 together with the frame 14 can be withdrawn to the right from the filling region and assume the position 11' so as to allow free flow of the coke from the coke transporting container 5 into the cooling shaft 1. The raising and lowering movement as well as the lateral displacement of the plate is performed by actuating arrangements which are not shown in the drawing for the sake of clarity.

Guiding members 16 are provided above the closing device 3 in the lower support housing 4. They deviate the flow of the coke so that the sand seal 13 or the like is protected against contact with the coke. The lower support housing 4 has a suction pipe identified by reference numeral 19. The suction pipe 19 serves for aspiration of the cooling gas which travels from the cooling shaft 1 into the lower support housing 4 in condition when the plate 11 is withdrawn in lateral direction.

It will be understood that each of the elements described above, or two or more together, may also find a useful application in other types of constructions differing from the types described above.

While the invention has been illustrated and described as embodied in an arrangement for feeding glowing coke it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for feeding a glowing coke, comprising means forming a cooling shaft into which coke and cooling gas are to be introduced; a coke transporting container adapted to be placed atop said shaft and having a closable bottom opening for operatively communicating said coke transporting container with a coke inlet opening of said cooling shaft, said coke transporting container being provided with at least two cover plates which are pivotable upwardly for receiving coke into said container; and a closing device arranged in said cooling shaft below said coke inlet opening and including a housing sealed from the ambient atmosphere, and a closing plate which is raisable and lowerable and also displaceable in a substantially horizontal direction in said housing.

2. An arrangement as defined in claim 1; and further comprising means for sealing said closing plate.

3. An arrangement as defined in claim 2, wherein said sealing means includes a peripheral portion of said closing plate and a sealing body with which said peripheral portion of said closing plates cooperates for sealing the latter.

4. An arrangement as defined in claim 3, wherein said sealing portion is formed by a downwardly bent projection of said closing plate.

5. An arrangement as defined in claim 4, wherein said sealing body is a sand seal into which said bent projection engages.

6. An arrangement as defined in claim 4, wherein said sealing body is a body of water into which said bent projection is dipped.

7. An arrangement as defined in claim 1, wherein at least one of said cover plates is formed as a guiding element for guiding coke into one part of said coke transporting container.

8. An arrangement as defined in claim 7, wherein said one cover plate has an upper surface and is provided with guiding means arranged on said upper surface.

9. An arrangement as defined in claim 8, wherein said guiding means includes a guiding projection provided on said upper surface of said one cover plate.

10. An arrangement as defined in claim 1, wherein said coke transporting container has more than two such cover plates, some of said cover plates being formed as guiding elements for guiding coke into some parts of said container.

11. An arrangement as defined in claim 1, wherein said coke transporting container is provided with a conical raisable and lowerable bottom closure.

* * * * *